US008672377B2

(12) United States Patent
Ina

(10) Patent No.: US 8,672,377 B2
(45) Date of Patent: Mar. 18, 2014

(54) EATING UTENSIL

(76) Inventor: Michel Ina, Lyndhurst, OH (US)

( * ) Notice: Subject to any disclaimer, the term of this patent is extended or adjusted under 35 U.S.C. 154(b) by 1161 days.

(21) Appl. No.: 12/046,532

(22) Filed: Mar. 12, 2008

(65) Prior Publication Data

US 2008/0224490 A1 Sep. 18, 2008

Related U.S. Application Data

(60) Provisional application No. 60/906,259, filed on Mar. 12, 2007.

(51) Int. Cl.
*B25B 7/00* (2006.01)

(52) U.S. Cl.
USPC ..... 294/99.2; D7/686

(58) Field of Classification Search
USPC ..... 294/99.2; 99/394, 421 A; 30/147–150, 30/322–328
See application file for complete search history.

(56) References Cited

U.S. PATENT DOCUMENTS

| | | | | | |
|---|---|---|---|---|---|
| 1,299,229 | A | * | 4/1919 | Roper | 294/99.2 |
| 2,452,332 | A | * | 10/1948 | Siptrott | 294/99.2 |
| 2,505,289 | A | * | 4/1950 | Haslett | 294/93 |
| 2,601,766 | A | * | 7/1952 | Riddell et al. | 30/124 |
| 3,239,262 | A | | 3/1966 | Rines et al. | |
| 3,489,151 | A | * | 1/1970 | Eller | 606/106 |
| 3,640,561 | A | | 2/1972 | Law | |
| 3,807,781 | A | | 4/1974 | Rollband | |
| 3,892,435 | A | | 7/1975 | Huey | |
| 3,937,510 | A | | 2/1976 | Lew | |
| 4,126,962 | A | * | 11/1978 | Polcaro | 47/1.5 |
| 4,659,128 | A | | 4/1987 | Dong | |
| 4,707,922 | A | | 11/1987 | Hosak-Robb | |
| 4,715,639 | A | | 12/1987 | Nicoletta et al. | |
| 4,721,334 | A | | 1/1988 | Nakatsu | |
| 4,809,435 | A | | 3/1989 | Printz | |
| 5,056,173 | A | | 10/1991 | Brincat | |
| 5,277,464 | A | | 1/1994 | Okun | |
| D345,086 | S | | 3/1994 | Shapiro | |
| D374,379 | S | | 10/1996 | Jee et al. | |
| 5,810,411 | A | | 9/1998 | Major | |
| 6,276,734 | B1 | | 8/2001 | Krieger | |
| 6,402,214 | B1 | | 6/2002 | Weiner | |
| 6,454,328 | B1 | | 9/2002 | Barillos | |
| 6,581,997 | B1 | | 6/2003 | Martikainen et al. | |
| 7,017,964 | B2 | | 3/2006 | Hao | |
| 7,052,061 | B2 | | 5/2006 | Calagui | |
| 2002/0096898 | A1 | | 7/2002 | Kang | |
| 2003/0197390 | A1 | | 10/2003 | Choi et al. | |
| 2004/0051327 | A1 | | 3/2004 | Yoon | |
| 2005/0082855 | A1 | | 4/2005 | Baxter | |

FOREIGN PATENT DOCUMENTS

| | | | |
|---|---|---|---|
| JP | 2005137876 | A | 6/2005 |
| WO | 2007/049887 | A1 | 5/2007 |
| WO | 2007/083887 | A1 | 7/2007 |

* cited by examiner

*Primary Examiner* — Saul Rodriguez
*Assistant Examiner* — Brendan Tighe
(74) *Attorney, Agent, or Firm* — Rankin, Hill & Clark LLP

(57) ABSTRACT

An eating utensil has first and second elongated stick members extending parallel to each other and a U-shaped connector attaching the stick members together. Each of the stick members has a base portion extending in a first plane, a intermediate portion extending in a second plane, and an end portion extending in a third plane. The connector located in the first plane and attaches together the base portion of the first stick member with the base portion of the second stick member. Both of the stick members are thus curved to facilitate handling and use of the utensil.

2 Claims, 6 Drawing Sheets

EATING UTENSIL

FIELD OF INVENTION

The present invention relates to an eating utensil for picking up food pieces, and more particularly to a utensil similar to chopsticks but which is easier to handle and use.

BACKGROUND OF THE INVENTION

While in Western cultures, forks are the most commonly used eating utensil for picking up pieces of food, chopsticks are mainly used in most East Asian countries such as China and Japan. An increasing number of people accustomed to forks or non-chopstick utensils become exposed to chopsticks when eating in East Asian restaurants. Many Westerners accustomed to eating with forks for their entire lives have initial difficulty handling chopsticks, and many are never completely comfortable using chopsticks. Chopsticks are relatively easy to use for those who have been using them throughout their lifetime and who are brought up using only chopsticks at every meal, but for those accustomed to forks, the experience of handling two separate elements in one hand can be very difficult. These problems affect those relatively new to chopsticks, and also affect children and the infirmed.

To overcome many of the difficulties in handling food by novice chopstick users, a number of modified chopsticks designs have been developed.

For example, U.S. Design Pat. No. 345,086, issued to Shapiro, incorporates two chopstick type tong elements into a single utensil having a U-shaped connecting portion at one end with a central disc-shaped fulcrum between the tong elements to assist in pivoting the tong elements together. Each of the tong elements has knurled ribs along the inside edge to assist in picking up food pieces.

U.S. Pat. No. 6,402,214, issued to Weiner, shows a U-shaped holder for a pair of conventional chopsticks, in which the holder comprises a paper or plastic flexible drinking straw.

U.S. Pat. No. 4,707,922, issued to Hosak-Robb, shows an eating implement with a tong-like body with two rod-like members connected by a resilient web. While the device is designed to replace conventional chopsticks, it operates like small tongs.

U.S. Pat. No. 3,640,561, issued to Law, describes a V-shaped utensil in which each of the straight chopstick-like members is joined together at one end, resulting in a tweezers-like configuration.

U.S. Pat. No. 3,892,435, issued to Huey, and U.S. Design Pat. No. 374,379, issued to Jee et al., disclose eating utensils in which the two chopstick-like members are connected together a one end by an M-shaped connection, providing a spring-like connection between the two elements.

U.S. Patent Application Publication No. 2004/0051327, filed by Yoon, shows a chopstick-type eating utensil in which two chopstick-like members are attached at one end by a connecting support.

U.S. Pat. No. 3,937,510, issued to Lew, discloses a pair of conventional chopsticks which are coupled together by a spring, so that the assembly resembles a spring clothespin. Japan Patent Publication No. 2005137876, issued to Pigeon Corp., shows a similar device.

U.S. Pat. No. 4,659,128, issued to Doug, and U.S. Pat. No. 7,052,061, issued to Calagui, show a pair of conventional chopsticks connected together with a spring loaded connector having hollow tubes for insertion of each of the chopsticks.

U.S. Pat. No. 4,312,530, issued to Young, and U.S. Pat. No. 4,715,639, issued to Nicoletta et al. disclose chopsticks assemblies in which the chopsticks are pivoted together in the middle resulting in a scissors-like arrangement.

U.S. Pat. No. 3,807,781, issued to Rollband, shows a modified chopstick assembly in which a support member is attached between the distal ends of the chopsticks to hold them together. U.S. Pat. No. 6,581,997, issued to Martikainen et al., discloses chopsticks which interlock to keep them held together at the distal end. Similarly, U.S. Pat. No. 3,239,262, issued to Rines et al., U.S. Pat. No. 4,721,334, issued to Nakatsu, U.S. Pat. No. 6,454,328, issued to Barillos, U.S. Patent Application Publication No. 2005/0082855, filed by Baxter, U.S. Patent Application Publication No. 2003/0197390, filed by Choi et al, and U.S. Patent Application Publication No. 2002/0096898, field by Kang, all disclose chopstick holders which attached to the distal end of a pair of conventional chopsticks to assist in holding the chopsticks together.

U.S. Pat. No. 4,809,435, issued to Printz, and U.S. Pat. No. 5,056,173, issued to Brincat, both show eating utensils in which the two chopstick members are connected at one end with a fork-like element, allowing the utensil to be used from either end as either chopsticks or a conventional fork.

Many of these designs are clumsy to handle, and subject to failure and expensive to manufacture due to their complicated designs. None provide a simple aesthetically pleasing chopstick-like eating utensil which is as easy to handle as pair of tongs. In addition, none provide substantial ergonomic benefits or are designed to fit the user's hand in a superior manner.

Conventional chopsticks also have a further disadvantage in that they can be contaminated by contact with the surface of the table when not in use. Some restaurants and individuals provide chopstick rests on which the chopsticks can be placed when not in use. However, providing these chopsticks rests costs money, time and effort, they can become dirty, and it is often troublesome for the diners who must set down the chopsticks on the rests every time. The modified chopstick designs discussed above generally do not address this problem, since they utilize straight chopstick-like members which cannot be placed on the table surface without being contaminated.

Due to the difficulty in handling chopsticks, many dinners resort to using forks when eating East Asian food. Forks often seem out of place in consuming East Asian food, but are often the only available alternative for those that may have difficulty with conventional chopsticks. Nevertheless, forks are not always the best choice for eating all kinds of food because they require either stabbing food morsels in order to lift them to the user's mouth or shoveling them onto the tines. For eating some types of food, such as noodles, forks are often ill-suited because noodles cannot be easily stabbed and slither off forks when an attempt is made to scoop them up. Forks also present the possibility of stabbing oneself in the cheek or tongue with the fork's prongs when one puts the food items in one's mouth. Thus, the western fork and the eastern chopsticks are limited in functioning properly in regard to both western and eastern dishes.

SUMMARY OF INVENTION

The present invention overcomes many of these problems, and provides a unique and advantageous design for an eating utensil which is easy for the user to handle, which is simple and inexpensive to make, and which provides a pleasing appearance.

The present invention provides a one-piece chopstick-like eating utensil that can be handled much more easily than conventional chopsticks. This allows persons who have little experience with chopsticks to eat Asian cuisine in a more authentic manner with little or no practice handling chopsticks. It also allows children, the elderly, and others with lesser motor skills to eat using a chopstick-like utensil.

The utensil of the present invention has a unique curved design in which each of the parallel sticks has several changes in linear direction. This permits the utensil to be used in different orientations and improves the ergonomic properties of the utensil. The utensil is capable of being held in one position so that the food engaging ends of the utensil point downwardly, facilitating grabbing food morsels from the plate and moving them to the mouth, usually one at a time. By simply turning the utensil over and holding it in the same position, the food engaging ends of the utensil point along the plate surface, facilitating scooping up food morsels from the plate. In addition, this position affords the user the ability to manipulate, guide, and secure multiple food items between the end portions and guide them to his or her mouth. Thus, the utensil can be orientated in different positions without changing the way the utensil is held in order to perform different eating functions, while continuing to keep food a safe distance from the user's hand. The utensil also provides similar advantages when used as a cooking utensil, in that it may be held on one orientation for picking up food pieces and in another orientation to scoop them up.

The curved design of the utensil allows it to be placed on a flat surface of a table in such a manner that the food engaging portion of the utensil rests in a position elevated from the table surface, preventing contamination, while eliminating the need for chopstick resting plates or the like. In addition, the raised profile of the utensil makes it easier to pick up when it is resting on a flat surface.

The utensil of the present invention can also be advantageously used in other applications. It can be used in exercises such as picking up a tissue or a button which can be employed in occupational therapy and physical rehabilitation.

The utensil can be produced inexpensively, it can be reused, and it can be made from environmentally friendly and recyclable materials.

These and other advantages are provided by the present invention of an eating utensil comprising first and second elongated stick members extending parallel to each other and a U-shaped connector attaching the stick members together. Each of the stick members has a base portion extending in a first plane, a intermediate portion extending in a second plane, and an end portion extending in a third plane. The connector located in the first plane and attaches together the base portion of the first stick member with the base portion of the second stick member.

DETAILED DESCRIPTION OF PREFERRED EMBODIMENTS

Figure 1:
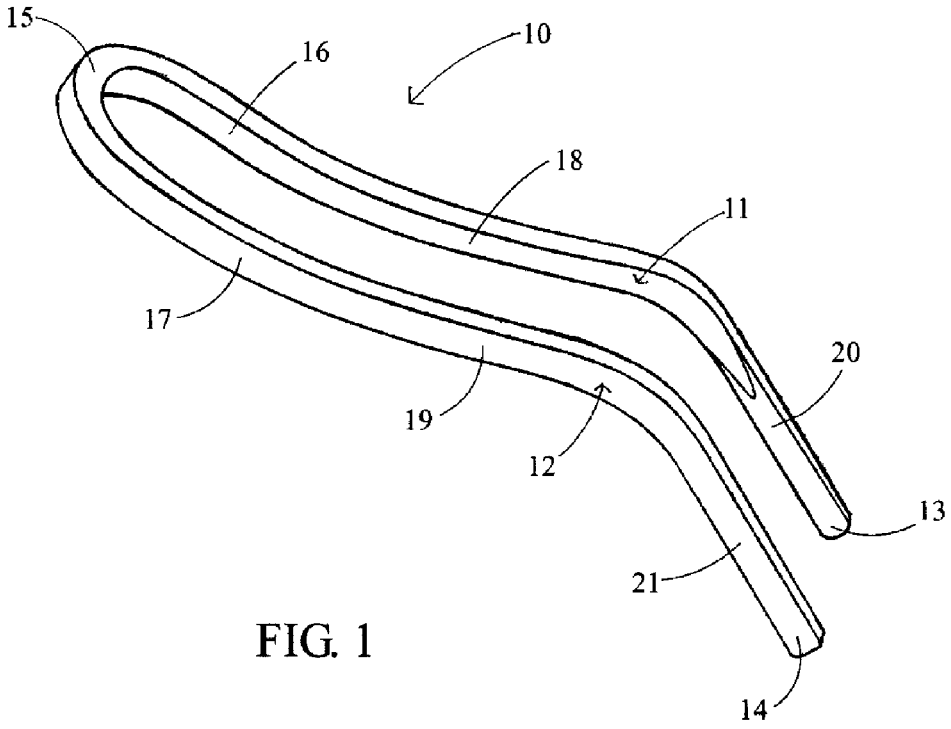
FIG. 1 is a perspective view of the utensil of the present invention in one orientation.
Figure 2:
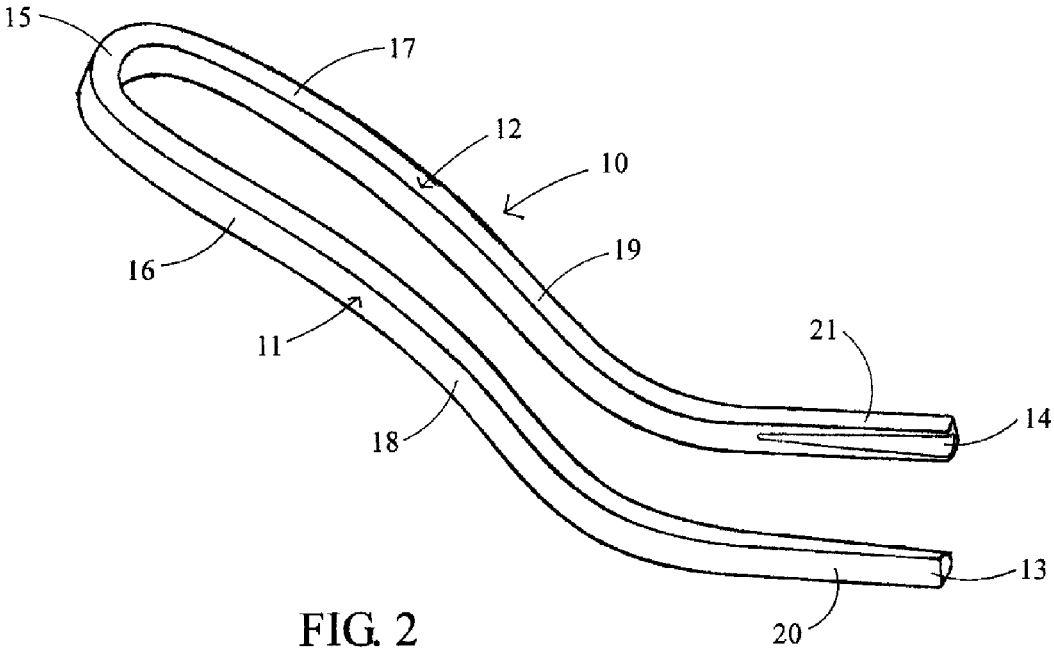
FIG. 2 is a perspective view of the utensil of FIG. 1 turned over such that it is in another orientation.

Referring more particularly to the drawings, and initially to FIGS. 1 and 2, there is shown an eating utensil 10 according the present invention. The utensil comprises a pair of chopstick-like sticks 11 and 12, each having a generally square cross section, and each about ¼ inch (6 mm) wide. The sticks 11 and 12 extend parallel to each other, and each stick has a free end 13 or 14 where pieces of food are engaged to be picked up and eaten. The free ends are preferably blunt, so that the user is not harmed by sharp edges when placing a piece of food in the mouth. The sticks 11 and 12 are attached to each other at the other end by a U-shaped connector 15. The connector 15 normally maintains the two sticks 11 and 12 in a parallel relationship with each of the sticks spaced from each other approximately 1 to 1½ inches (25 to 38 mm) apart. The connector 15 is flexible to allow the sticks 11 and 12 to be squeezed together by the user so that pieces of food are pinched between the free ends 13 or 14. The connector 15 is also resilient so that the pieces of food that are held between the free ends 13 or 14 are released when the sticks 11 and 12 are no longer squeezed together. The utensil 10 is preferably about 6 to 7 inches (150 to 180 mm) long, but may be longer or shorter as desired. For example, a smaller utensil may be provided for children, and larger utensils may be provided for persons having larger hands.

Figure 3:
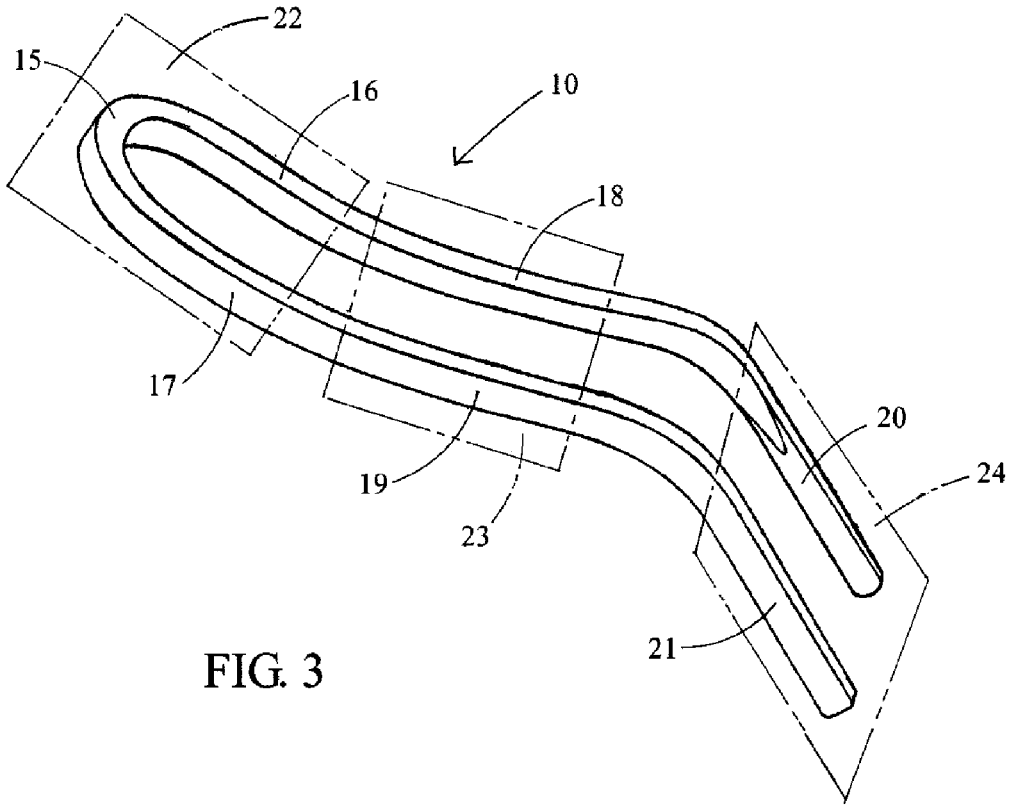
FIG. 3 is a perspective view of the utensil similar to FIG. 1 showing the planes in which portions of the utensil lie.
Figure 4:
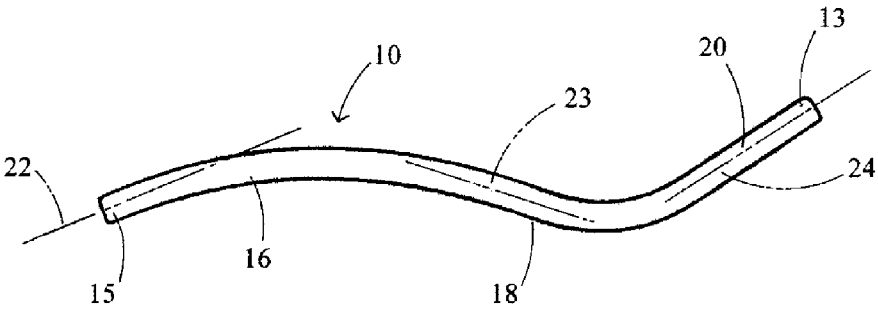
FIG. 4 is a side elevational view of the utensil in the orientation of FIG. 2.

Rather than being straight as with conventional chopsticks, each of the sticks 11 and 12 is curved to facilitate handling the utensil 10 and employing the utensil in picking up pieces of food. Each stick 11 or 12 comprises a base portion 16 or 17, an intermediate portion 18 or 19, and an end portion 20 or 21, respectively. As shown in FIGS. 3 and 4, the base portions 16 and 17 both extend in a first plane 22. The connector 15 also extends in the first plane 22. The intermediate portions 18 and 19 both extend in a second plane 23 which intersects the first plane 22, an obtuse angle being formed between first and second planes. The base portions 16 and 17 are connected to the intermediate portions 18 and 19 by continuous curved first transition portions. The end portions 20 and 21 both extend in a third plane 24 which intersects the second plane 23, an obtuse angle being formed between the second and third planes. The intermediate portions 18 and 19 are connected to the end portions 20 and 21 by continuous curved second transition portions. The end portions 20 and 21 at their intersection with the intermediate portions 18 and 19 thus extend back toward the first plane 22, so that the free end of each of the sticks is located approximately in the first plane, allowing the utensil 10 to lie flat when it is resting. For each of the sticks 11 and 12, the transitions from the connector 15 to the base portion 16 or 17, from the base portion to the intermediate portion 18 or 19, and from the intermediate portion to the end portion 20 or 21 is curved and smooth, so that the utensil 10 presents an overall sleek appearance. The utensil 10 is symmetrical, so that it can be used by right- and left-handed persons with equal facility. The utensil 10 is molded or otherwise formed from a single piece of resilient synthetic plastic material. One desirable material is nylon colored an offwhite to resemble fine ivory chopsticks. The utensil 10 may also be made of metal or a composite material. However, it is preferable that the material be resilient so that the sticks 11 and 12 can be pinched together by the user, and the sticks will return to their original parallel orientation when released.

Figure 6:
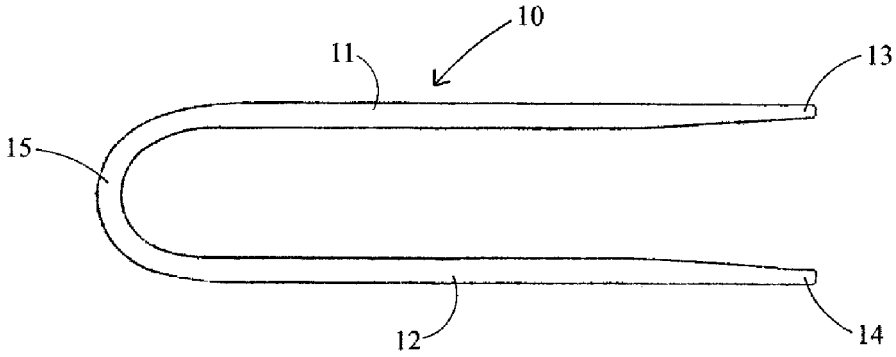
FIG. 6 is a top plan view of the utensil in the orientation of FIG. 2.

As shown particularly in FIG. 6, each of the end portions 20 and 21 is tapered such that the free ends 13 and 14 are narrower than the rest of sticks. This increases the contact surface area on the inside of the sticks when the sticks are squeezed together and provides a more secure engagement of the good items when they are picked up. Furthermore, since the sticks are made from a flexible resilient material, the end portions 20 and 21 can bend slightly after the free ends 13 and 14 touch each other as the ends are forced further together, providing a continuous elongated area in which pieces of food may be secured. This engagement length is preferably about 1½ inches long for the 6-7 inch long utensil of the preferred embodiment.

Figure 5:
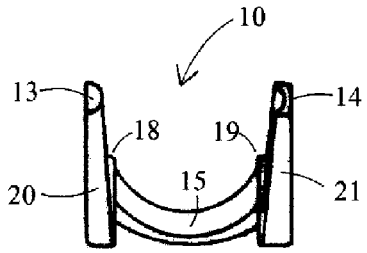
FIG. 5 is an end elevational view of the utensil in the orientation of FIG. 2.

If desired, the cross sections of the free ends 13 and 14 of sticks can be modified to further facilitate the handling of pieces of food. As shown in FIG. 5, the cross section of one stick end can be formed into a semi-circle while the cross section of the other stick end formed into a complementary crescent shape. This increases the surface area engaging the food pieces when the end portions are squeezed together. Other cross sectional configurations are possible, such as, providing on end with two longitudinal projections with a central groove while the other end has a semi-circular crescent shaped indentation, such that two points of engagement are provided to keep food pieces from turning and to help align the two ends together when they are pinched toward each other.

As shown in FIGS. 7-10, the utensil 10 may be handled by a user in various ways, and the curved configuration of each of the sticks enhances its use in each configuration. In the grasping configuration shown in FIG. 7, the utensil 10 is held in the user's hand H between the thumb and index finger such that the end portions of the sticks extend generally downwardly. This maximizes the contact of the free ends of the sticks with the food morsel in the vertical direction. The morsel can then be picked up and transferred to the user's mouth. In the scooping position shown in FIG. 8, the utensil 10 is still held by the user between the thumb and index finger, but the utensil is flipped over so that the end portions extend generally horizontally. This facilitates pushing a food morsel along the surface of the plate so that it can be scooped up and transferred to the user's mouth. It will be noted that either configuration of handling the utensil 10 can be accomplished using the same basic orientation of the user's hand, and the utensil is held in an almost identical manner between the thumb and index finger. This is because the curved configuration of the utensil 10 allows the free ends to be oriented in a substantially horizontal or substantially vertical position without changing the user's hand position, simply by holding the utensil so that the end portions extend up or extend down.

Figure 7:
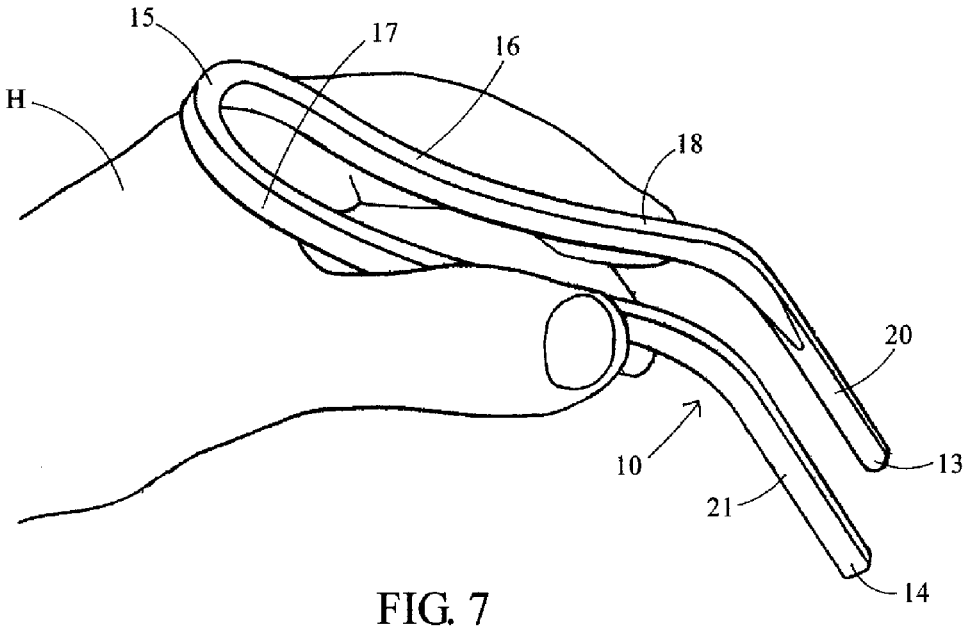
FIG. 7 is a perspective view of a user holding the utensil in the grasping orientation of FIG. 1.
Figure 8:
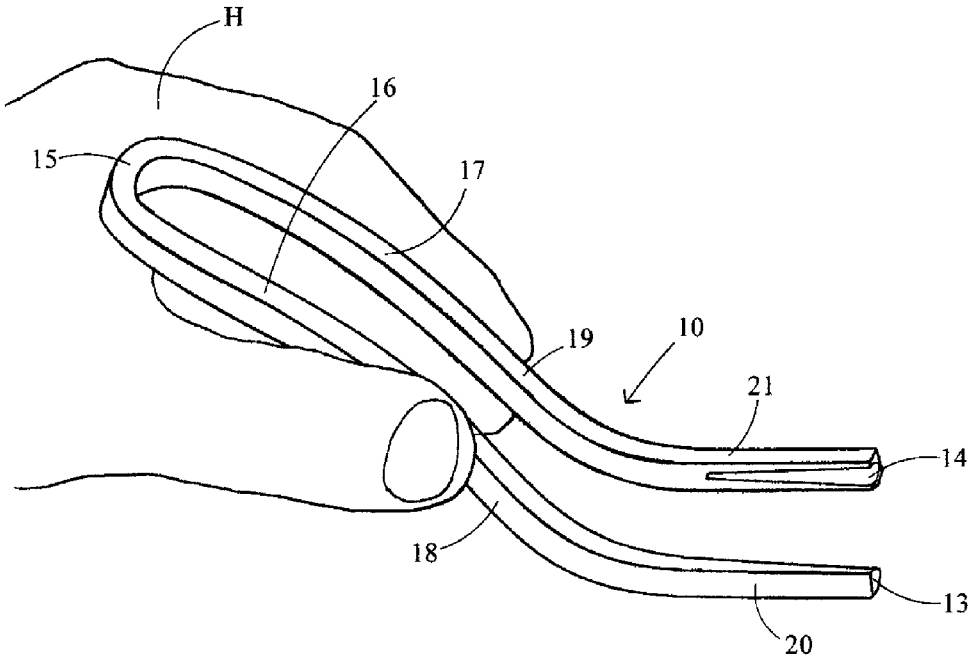
FIG. 8 is a perspective view similar to FIG. 7 showing the user holding the utensil in the scooping orientation of FIG. 2.
Figure 9:
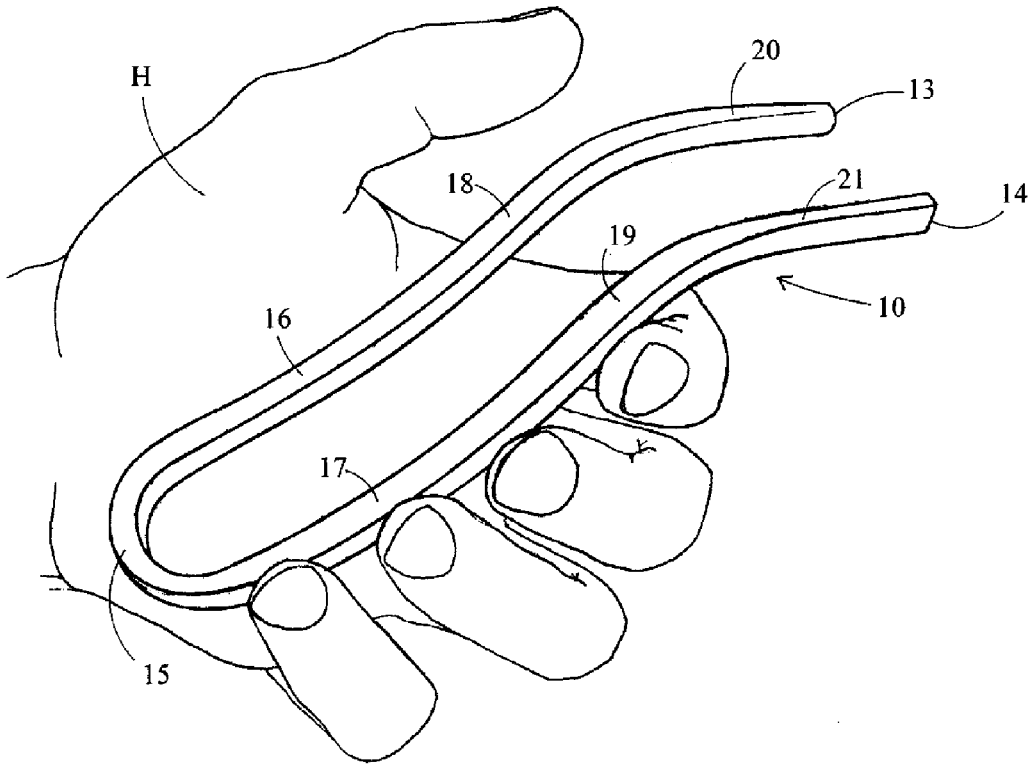
FIG. 9 is a perspective view similar to FIGS. 7 and 8 showing the user holding the utensil in a different manner.
Figure 10:
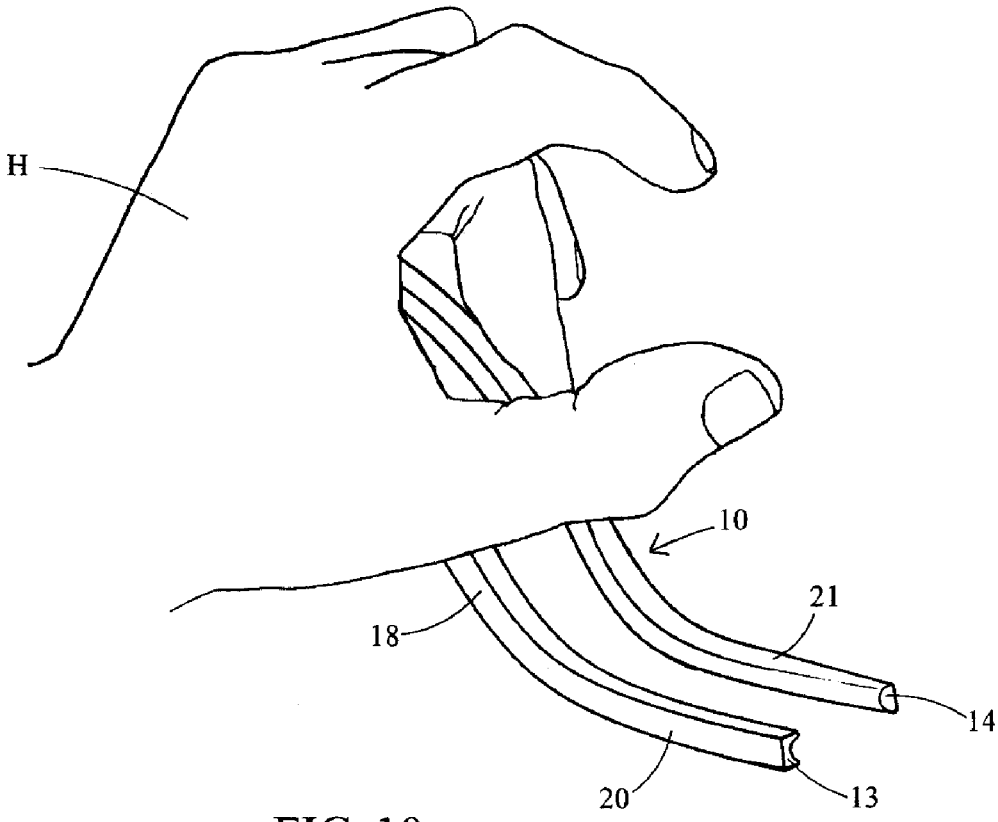
FIG. 10 is a perspective view similar to FIGS. 7-9 showing the user holding the utensil in yet another manner.

In some circumstances, it may be difficult for the user to manipulate the utensil 10 in the manner shown in FIGS. 7 and 8. For example, young children may not have mastered the ability to pinch together the sticks using the thumb and index finger to pick up items of food, or persons with reduced motor skills, joint instability or muscle weakness may lack the dexterity to handle the utensil in this manner. The utensil 10 of the present invention, however, need not be held between the index finger and thumb, and it may be handled in other ways while still using the advantages of the invention. As shown in FIG. 9, the utensil 10 can be held in the palm of the hand H allowing it to be squeezed between all of the fingers and the thumb. This method of handling the utensil may be particularly advantageous for very young children who lack mature motor skills, but it may also provide benefits for persons having injuries or impairments. As shown in FIG. 10, the utensil 10 can also be held in the user's hand H so that it is squeezed between the long or ring fingers and the base of the palm without use of the index finger or thumb. Thus, the utensil has various means of manipulation, and is far more versatile in its capabilities than conventional chopsticks or other modified chopstick designs.

It can also be seen that the utensil 10 can be placed down on a flat surface, such as a table with the utensil resting on the connector and the junction of the intermediate and end portions of the sticks, so that the free ends of the sticks are elevated from the table surface. This allows the utensil 10 to be placed down on the table when not in use during the meal without contaminating the eating ends of the utensil. This avoids the cost and bother of providing chopstick rests sometimes used in place settings at restaurants and elsewhere on which chopsticks are placed when not in use, which involves extra costs and bother, and is troublesome for the diners who must set down the chopsticks on the rests every time. When the utensil of the present invention is placed down in this manner, the upturned free ends of the sticks do not contact a table surface.

In addition, when the utensil 10 is placed down on the edge of a bowl or plate with the free ends pointing downwardly, the free ends hook over the edge of the bowl or plate preventing the utensils from easily disengaging and falling to the surface of the table. Thus, the utensil provides a further advantage in assuring the eating ends of the utensil are not inadvertently contaminated during the meal.

Furthermore, the contoured profile of utensil sticks facilitates grasping the utensil by the user when the user is picking the utensil off the table surface. Unlike straight chopsticks which may be difficult to pick up since they lie flat on the table surface, the utensil of the present invention includes portions which rise about the table surface, making the utensil easier to pick up. The contoured profile of the utensil also provides the user with better ergonomic response and control of said eating utensil when performing a scooping and a picking action through the two sided ergonomic and functional engagement of the said eating utensils.

It should also be appreciated that the food eaten using the utensil 10 of the present invention is generally eaten much more slowly than with a conventional fork. The utensil thus has the added benefit of slowing down the consumption of food at a meal, and allowing the user's appetite to "catch up" with his or her eating. It has been shown that eating more slowly reduces the amount of food consumed, because the eater begins to feel more full before additional food is consumed. Regular use of the utensil of the present invention in place of a conventional fork will thus promote healthy eating habits by slowing down food consumption, and possibly reduce overeating.

It should be realized that the embodiment described herein is only representative of the invention and is not intended to limit the invention to one particular embodiment as the invention includes all embodiments falling within the scope of the appended claims. Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. An eating utensil comprising:

first and second elongated stick members extending parallel to each other, each of the stick members having a base portion extending in a first plane, a intermediate portion extending in a second plane, and a food-engaging end portion extending in a third plane, each of the end portions having a smooth inner food-engaging surface extending longitudinally along the side of the end portion; and a U-shaped connector located in the first plane and attaching together the base portion of the first stick member with the base portion of the second stick member;

wherein the connector is flexible to allow the end portions of the stick members to be moved toward each other;

wherein each of the end portions is flexible to allow an elongated continuous engagement of the food-engaging surfaces of the end portions.

2. An eating utensil comprising:

first and second elongated stick members extending parallel to each other, each of the stick members having a base portion extending in a first plane, a intermediate portion extending in a second plane, and a food-engaging end portion extending in a third plane, each of the end portions having a smooth inner food-engaging surface extending longitudinally along the side of the end portion; and a U-shaped connector located in the first plane and attaching together the base portion of the first stick member with the base portion of the second stick member;

wherein the inner food engaging surfaces of the end portions have complementary engaging surfaces;

wherein one of the end portions includes a semicircular cross-section that protrudes inwardly and the other of the end portions includes a crescent shaped cross section that forms an outwardly extending recess, so that one of the engaging surfaces is inwardly curved and the other of the engaging surfaces has a complementary outwardly curved indentation.

* * * * *